United States Patent [19]

Parker et al.

[11] 3,990,407

[45] Nov. 9, 1976

[54] EXPLOSIVELY POWERED ROTARY TOOL

[76] Inventors: James T. Parker, 3037 W. 30th Court; William R. Buffkin, Rte. 3, Box 510M, both of Panama City, Fla. 32401

[22] Filed: Aug. 18, 1975

[21] Appl. No.: 605,800

[52] U.S. Cl. ..... 123/24 A; 81/52.3; 60/39.47; 60/634; 123/24 R

[51] Int. Cl.[2] ..... F02B 45/06

[58] Field of Search ..... 81/52.3; 60/39.47, 634, 60/632; 123/24 R, 24 A, 183

[56] References Cited

UNITED STATES PATENTS

| | | | |
|---|---|---|---|
| 1,921,344 | 8/1933 | Chlton | 60/39.47 X |
| 2,208,496 | 7/1940 | Coffman | 123/24 A |
| 2,652,781 | 9/1953 | Deardoff et al. | 123/183 X |
| 3,046,897 | 7/1962 | Badenoch | 60/39.47 X |
| 3,089,419 | 5/1963 | Pollard | 60/634 X |
| 3,129,619 | 4/1964 | Harrison | 81/52.3 |
| 3,210,931 | 10/1965 | Elzufon et al. | 60/39.47 X |
| 3,270,593 | 9/1966 | Kaman | 81/52.3 |
| 3,417,566 | 12/1968 | Gould | 60/39.47 X |

*Primary Examiner*—Wendell E. Burns
*Attorney, Agent, or Firm*—Richard S. Sciascia; Don D. Doty; Harvey A. David

[57] ABSTRACT

An explosively powered tool or wrench is described that is operable under water and provides high torque, approaching that of an impact wrench, through the detonation of small charges to generate pressure for driving pistons of an expansible chamber motor. The invention is characterized by a rotating magazine for automatically or manually bringing charges into firing position, a magazine position indicator, and electrical firing control circuitry.

12 Claims, 3 Drawing Figures

EXPLOSIVELY POWERED ROTARY TOOL

STATEMENT OF GOVERNMENT INTEREST

The invention described herein may be manufactured and used by or for the Government of the United States of America for governmental purposes without the payment of any royalties thereon or therefor.

FIELD OF THE INVENTION

This invention relates to power driven rotary tools, and more particularly to explosively powered tools capable of delivering large rotational forces approaching or simulating mechanical impacts for short periods of time. As such, the invention is particularly well suited to be used, among other things, as a power wrench for loosening the largest of "frozen" nuts, for example, under difficult circumstances such as in underwater or remote locations.

DISCUSSION OF THE PRIOR ART

Current methods of removing large and/or stubborn nuts or bolts in underwater salvage or repair work include the use of metal cutting torches, directly applied explosives, and hydraulically or pneumatically operated impact wrenches. Cutting torches, and directly applied explosives usually result in substantial damage to the object being removed, as well as to adjacent structures. Cutting torches and conventional impact wrenches require considerable associated apparatus such as gas tanks, regulators, engine driven pumps, and the like, thereby limiting the ready portability and availability for salvage and repair work at remote locations, underwater, or the like.

U.S. Pat. No. 3,675,515 to L. L. Berg describes an impact wrench assembly to be used in conjunction with conventional power hammers so as exert a large rotational force or torque for loosening or tightening operations. Again, such power hammers generally require a source of pressurized fluid or electricity and are unwieldy at best.

Various explosive or solid fuel charged apparatuses have been devised for generating rotational forces, principally as starter motors for aircraft engines. For reasons pecuiliar to the application of starting forces to a reciprocating piston engine, such apparatus must avoid initial application of force with such rapidity as to approach an impact, but must effect a smooth and continuous development of torque over several or more output revolutions. The lack of impact effect renders such devices inappropriate, for example, for freeing seized nuts and bolts.

SUMMARY OF THE INVENTION

The present invention aims to overcome most or all of the disadvantages and shortcomings of the prior art through the provision of an explosively powered rotary tool or wrench wherein the successive firing of charges in a revolving cylinder produces expanding gasses that operate a positive displacement, expanding chamber motor so as to deliver a sequence of large rotational impulses to a workpiece.

With the foregoing in mind, it is a principal object of this invention to provide an improved power tool that operates on explosive or solid fuel charges.

Another object is the provision of an explosively powered tool that can operate to deliver impact-like applications of torque to a workpiece.

Still another object is the provision of such a tool or device that is simple and rugged of construction, is reasonably portable, and which includes a minimum of associated control elements.

Yet another object is the provision of a tool of the foregoing character which is operable either on land or underwater, thereby making it a notably useful adjunct to salvage, repair, or construction equipment to be used by divers or tool manipulating submersibles.

Other objects and many of the attendant advantages will be readily appreciated as the subject invention becomes better understood by reference to the following detailed description, when considered in conjunction with the accompanying drawings.

DESCRIPTION OF THE PREFERRED EMBODIMENT

Figure 1:
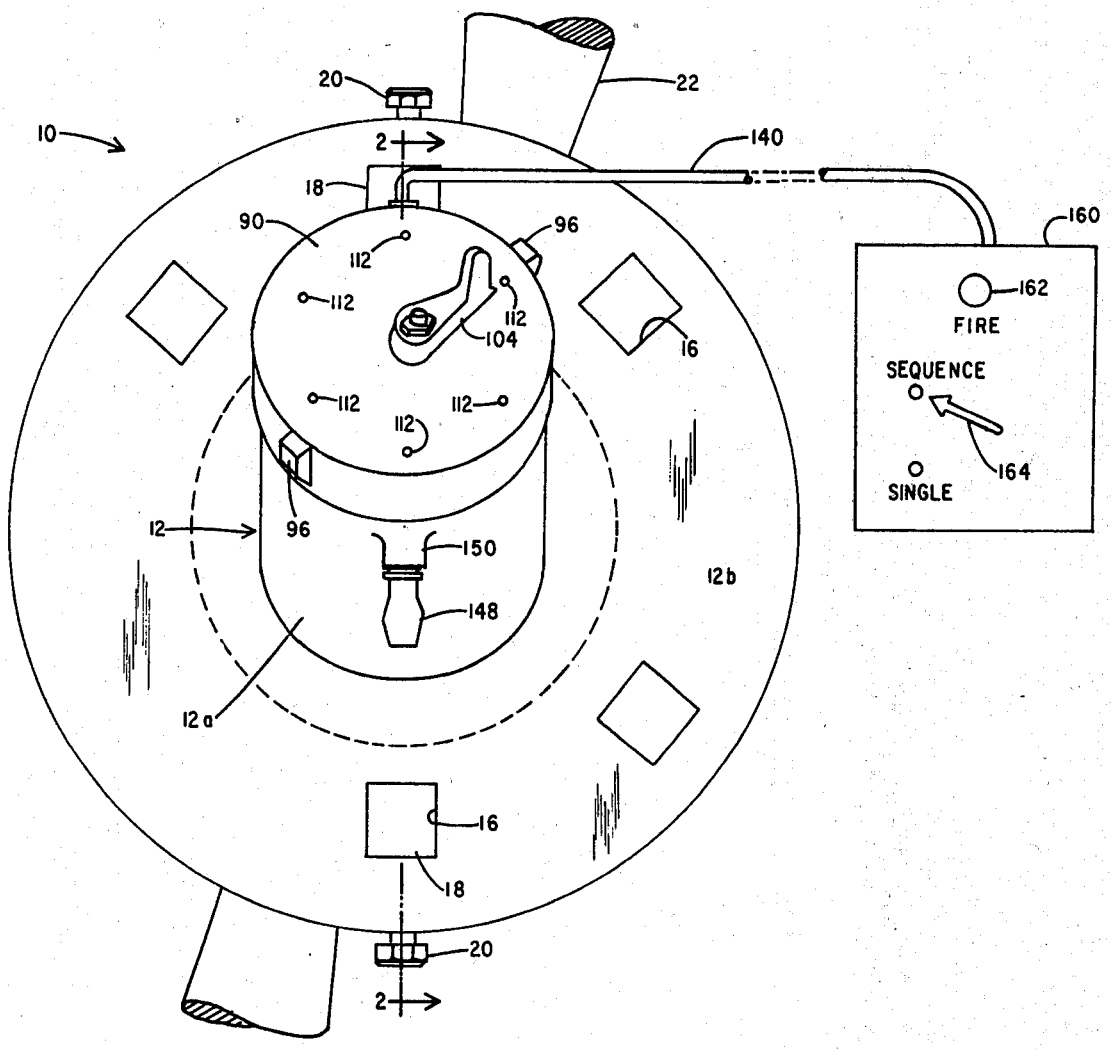
FIG. 1 is a front elevational view of an explosively powered wrench device embodying the invention.

In the form of the invention illustrated in the drawings and described hereinafter, there is provided an explosively driven rotary power tool or device 10 that is capable of generating high levels of torque for periods of short duration, enabling it to perform many of those tasks ordinarily attempted with power driven impact wrenches, but without certain disadvantages thereof. Device 10, comprises a body 12, preferably formed as a metal casting or forging, including a generally cylindrical portion 12*a* and a circular portion or flange 12*b* lying in a plane at other than a right angle with respect to the axis of the cylindrical portion.

Flange 12*b* is provided with a plurality of apertures 16 arranged at a variety of locations and in which tool retaining clamps or hooked bars 18 may be adjustably secured, as by set screws 20, to hold device 10 against rotation with respect to a workpiece. For example, when device 10 is used to loosen or remove a propeller shaft nut (not shown), bars 18 are adjusted to engage the blades of the propeller 22. A wide variety of clamps and bars may be used to secure device 10, and their particular configurations will be, of course, dictated by the nature and disposition of the work to be accomplished.

Cylindrical body portion 12*a* is provided with a cylindrical bore 30 in which is received a rotatable cylinder block 32 forming part of an expansible chamber motor. Cylinder block 32 comprises a plurality of parallel cylinder bores 34, six in number in the embodiment being described, arranged at equal distances from one another about the central rotational axis of the cylinder block.

Reciprocably mounted in the cylinder bores 34 are pistons 36 having piston rods 38, including ball joint ends 40, through which forces are transmitted to a rotor 42. Rotor 42 is disc shaped and is rotatably carried by a cover member 44 that is secured to body 12, as by cap screws 46. Cylinder block 32 is further connected to rotor 42 by an axial shaft 50 and spline type of universal joint 52. This connection assures that the cylinder block 32 and rotor 42 rotate in synchronism so that no canting or twisting of the pistons and piston rods will occur.

Extending from rotor 42 is an axial output shaft 54, which is conveniently journalled in cover member 44 and has a squared end portion adapted to drive a workpiece engaging element such as a wrench type socked 56.

Defined in body 12 are an inlet passage 60 and an exhaust passage 62 arranged at antipodal locations such that the inlet passage opens into the cylinder bore 34 having its piston 36 substantially at its most inward position.

Passage 60 further includes a portion 60*a* extending arcuately to one side of passage 60 so as to communicate with the cylinder bore adjacent the just mentioned bore. It will be recognized that application of fluid pressure via passage 60 and passage extension 60*a* to the cylinder bores 34 exposed thereto will urge cylinder block 32, rotor 42, and shaft 54 to rotate.

Development of fluid pressure according to this invention, is accomplished by detonation of explosive charges in chambers 66 of a revolving magazine 68. Magazine 68 is cylindrical in shape and is rotatably received in a cylindrical bore 70 of body 12, which bore is coaxial with bore 30. Rotation of magazine 68 in unison with rotation of cylinder block 32 is effected by a one way clutch or ratchet connection that permits the magazine to be rotated independently of the cylinder block for purposes which will presently be made apparent. Thus, a shaft 74 extends axially from magazine 68, through a bore 76 in body 12, and into a central bore 78 in cylinder block 32. The end of shaft 74 is provided with ratchet teeth, preferably equal in number to the number of charge containing chambers 66 in the magazine. A spring biased pawl 82 has a cylindrical head portion disposed in bore 78 and presenting teeth complementary comprises a non-cylindrical portion 82*a*, squared for example, reciprocable in a corresponding by shaped extension 78*a* of bore 78. A compression spring 84 resiliently urges pawl 82 into engagement with shaft 74 but permits pawl 82 to be displaced axially during overriding movement of teeth 80 of shaft 74 when magazine 68 is rotated independently of cylinder block 32.

Magazine 68 is retained in bore 70 against the reactionary forces of charge detonations in its chambers 66 by a breech block or cap 90 comprising a series of inturned lugs 92 that cooperate with an interrupted flange 94 on body 12. Breech cap 90 is thereby readily installed and removed by a partial turn with a suitable spanner wrench engaging ears 96 thereof. The outer face of magazine 68 bears directly against the inner surface 98 of cap 90, the magazine being machined to tolerances which permit rotation thereof in bore 70 and in the space between body surface 100 and cap surface 98.

Independent rotation of magazine 68 relative to cylinder block 32 is conveniently manually effected through the agency of an indicator handle 104 fixed to the outer end of a shaft 106 extending from the magazine through breech cap 90. Indicator handle 104 also cooperates with embossed or other indicia 112 to indicate the position of magazine 68 and which of its charges is in a position for firing.

An O-ring 108 serves to seal shaft 106 relative to breech cap 90 to preclude water intrusion when device 10 is used as a diver's tool. Likewise, an O-ring 110 is provided between body 12 and breech cap 90 for the same purpose.

Prior to assembly in device 10, magazine 68 has its chambers 66 loaded with explosive charges, conveniently in the form of electrically ignitable cartridges 116. Each cartridge comprises an electrically conductive shell 118, of brass or other metal, of stepped cylindrical configuration. A conductive terminal post 120 has an inwardly disposed head portion and is electrically insulated and sealed with respect to the shell 116 as by an insulating sleeve 122. An igniter filament is connected between terminal post 120 and shell 118 and is embedded in a suitable solid fuel charge 126 capable of being ignited or detonated by heating of the filament.

Application of an electrical current to the filament of each cartridge 116, in its turn, is provided for by means of a contactor 130 carried by a washer 132 of resilient, electrically insulating material in a suitable bore in breech cap 90 at a location in alignment with inlet passage 60. Contractor 130 is connected to an electrical conductor 134, leading through electrical insulation 136 in a passage 138, to become one of two conductors of a fire control cable 140. The other conductor 142 of cable 140 is electrically connected to breech cap 90 through a watertight threaded coupling 144.

Further, in consideration of the capability of device 10 to be used underwater, a non-return exhaust valve 148 is provided to exclude water from passage 62 while permitting a free flow of exhaust gas therefrom. Valve 148 is clamped to a nipple 150 formed on body 12 for that purpose.

It should be noted at this point that a pressure bleed-off passage 152 is provided in body 12 communicating between the inlet passage 60 and the medium surrounding device 10. A non-return or check valve 154 is provided to prevent water entry into those passages. The purpose of passage 152 is to bleed off pressure developed in inlet passages 60, 60*a* and the communicating cylinders 34 in the event a charge is fired in the aligned chamber 66 and no rotation, or only slight rotation, of the cylinder block 32 takes place. Such bleed-off of pressure permits a subsequent charge to be fired after being brought into firing position by handle 104. It will be understood that passage 152 is sufficiently restrictive as to produce little diminishment of the peak pressures generated upon firing of a charge.

Cable 140 leads to a fire control box 160 providing for selection of a single charge firing or a sequence of charge firings, in accordance with whether the task at hand should be limited to a single impulse, or requires a series that will produce more rotation. The former may be desirable for starting a "frozen" nut, while the latter may be removal thereof. To this end, control box 160 includes, in addition to a conventional press-to-fire, momentary contact switch 162, a selector switch 164 that in one position conditions the control box to produce a prolonged flow of electric current through cable 140, and in its other position conditions the control box to produce only a momentary flow.

Figure 3:
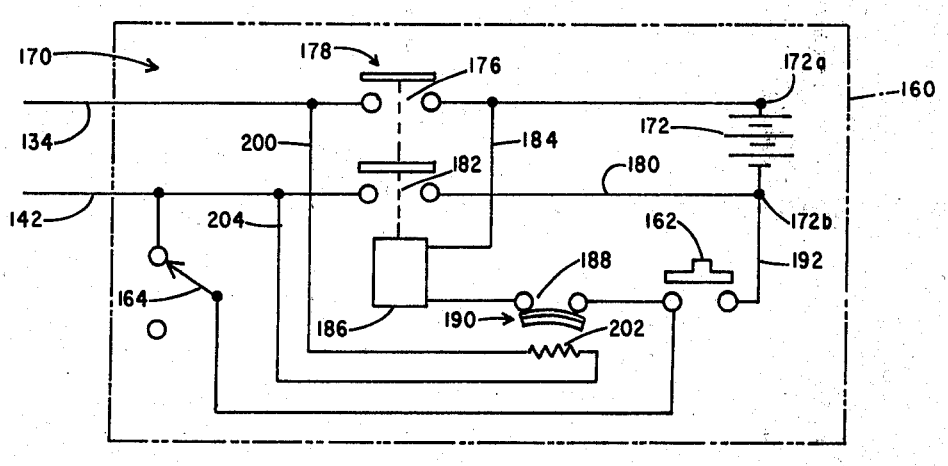
FIG. 3 is a diagrammatic illustration of a fire control circuit.
Figure 2:
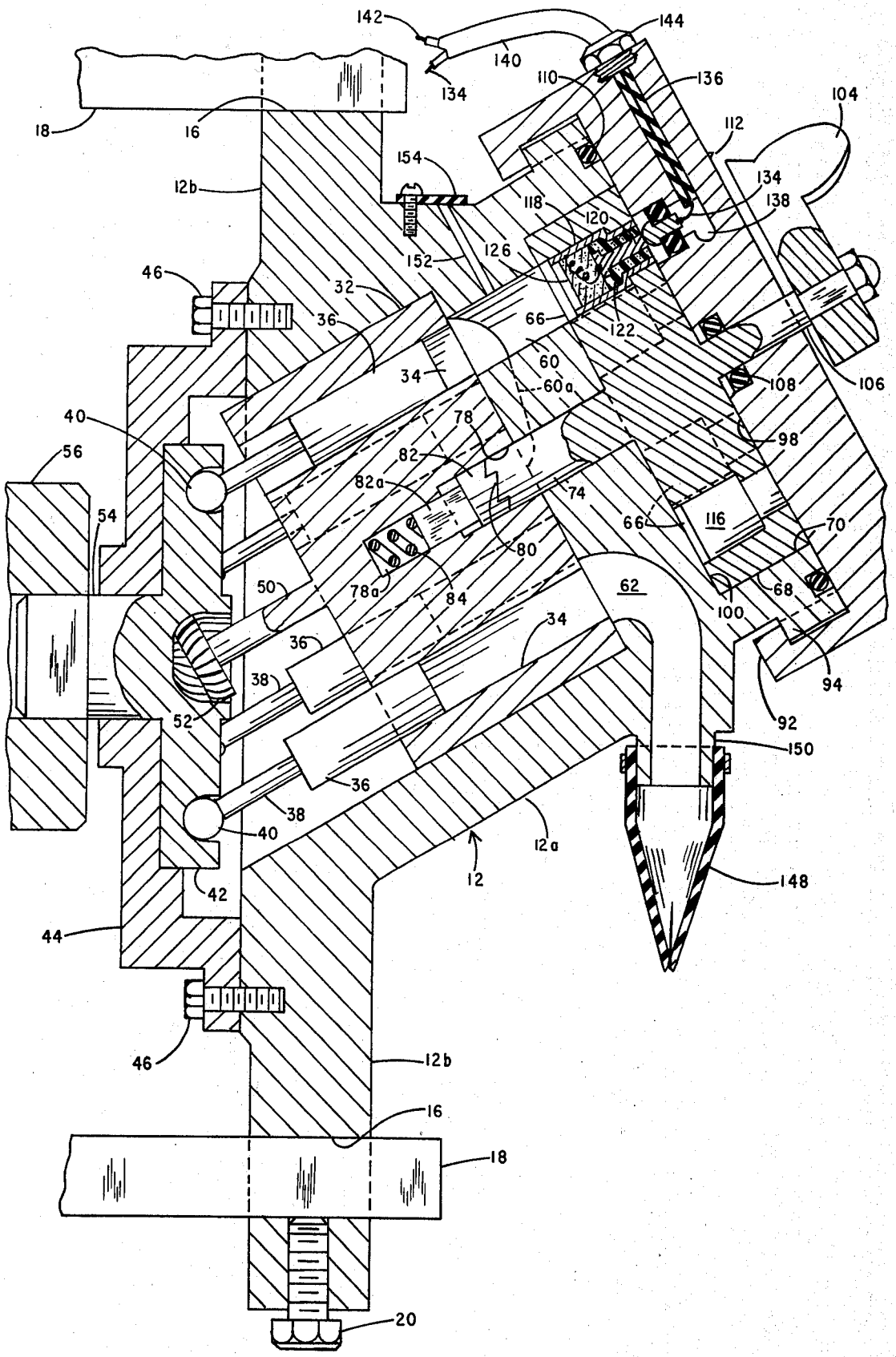
FIG. 2 is an enlarged sectional view taken substantially along line 2—2 of FIG. 1.

Referring to FIG. 3, a circuit 170 of control box 160 comprises a source of electrical current, conveniently a storage or dry cell battery 172. One terminal 172*a* of battery 172 is connected by a conductor 174 to one side of normally open contacts 176 of a relay 178. The other side of contact 176 is connected to conductor 134 of cable 140. The other terminal 172*b* of battery 172 is connected by a conductor 180 to one side of normally open contacts 182 of relay 78, the other side of which contacts are connected to conductor 142 of cable 140. Energization of relay 178 to apply current from battery 172 to cable conductors 134, 142 is achieved by a circuit which may be traced from battery terminal 172*a* through conductors 174, 184, solenoid 186 of relay 178, the normally closed contacts 188 of a time delay thermal relay 190, momentary contact switch 162, and a conductor 192 to battery terminal 172*b*.

When selector switch 164 is in its illustrated position, a holding circuit for relay 178 may be traced from battery terminal 172*a* through conductors 174, 184 relay solenoid 186, thermal relay contacts 188, a conductor 196, switch 164, conductor 142, relay contacts 182, and conductor 180 to battery terminal 172*b*.

When every relay contacts 176, 182 are closed, such as when the just described holding circuit is operative, a thermal relay heater circuit comprising conductor 200, filament 202 of thermal relay 190, and conductor 204. After a predetermined time interval, sufficient to permit sequential firing of all charges in magazine 68, thermal relay contacts 188 open to break the holding circuit for relay 178.

MODE OF OPERATION

In preparation for use of the device 10, breech cap 90 and magazine 68 are removed from body 12 and the magazine loaded with charge bearing cartridges 116. The loaded magazine and the breech cap are then reassembled with body 12. The device 10 is then fixed in working position using clamps or bars 18 to prevent rotation and dislodgement.

Indicator handle 104 is rotated, if necessary, to point to one of the indices 112, thereby assuring that magazine 68 is positioned with a cartridge engaged by contactor 130. With control box 160 at a safe location, e.g., above water if the device 10 is being used underwater, cable 140 properly connected, and switch 164 positioned for a single or a sequential firing as the circumstances of the job indicate, the fire switch 162 is activated to fire at least a first charge. Firing of a charge rapidly develops substantial pressure in inlet passages 60 and 60*a* that tend to drive the exposed pistons 36 toward rotor 42. Because of the angle at which the pistons move relative to the rotational axis of rotor 42, a substantial rotational torque is developed therein which is transferred via shaft 54 and socket 56 to the nut or other workpiece.

After such firing, inspection of the position of indicator handle 104 will reveal whether the workpiece has been moved. Assuming, for example, that it has not moved, or has not moved sufficiently to bring handle 104 to the next indicia 112, the handle may be manually rotated thereto by virtue of the ratchet coupling between the magazine 68 and the cylinder block 32. Another cartridge 116 is thereby brought into engagement with contactor 130 for a subsequent firing. This procedure may be repeated, as necessary to free the workpiece. Bleed-off passage 152 permits the high pressures, developed in passages 60, 60*a*, to dissipate between each individual detonation when a stubborn workpiece resists movement. When the workpiece is sufficiently free to turn at least one indicia on firing a charge, the control box may be conditioned to provide a prolonged electrical signal so that as each cartridge moves into engagement with contactor 130 it will be fired. The resulting rapid sequence of firings will maintain rotation of the output shaft for 360°, more or less, depending upon the number of unfired charges in the magazine. Because of the small size of bleed-off passage 152, and the rapidity of the sequential firings, little loss of effective pressure is experienced through that passage.

Obviously, other embodiments and modifications of the subject invention will readily come to the mind of one skilled in the art having the benefit of the teachings presented in the foregoing description and the drawing. It is, therefore, to be understood that this invention is not to be limited thereto and that said modifications and embodiments are intended to be included within the scope of the appended claims.

What is claimed is:

1. An explosively activated rotary tool device comprising:

a housing;

expansible chamber rotary motor means, mounted in said housing, for converting explosively generated gas pressure into torque;

said housing having defined therein an inlet passage for said motor means and an exhaust passage therefor;

magazine means comprising a plurality of explosive charge containing chambers, rotatably carried in said housing, for successively aligning said chambers with said inlet passage;

coupling means, disposed between said motor means and said magazine means, for causing said magazine means to rotate with said motor means; and firing means, carried by said housing, for igniting said charges when aligned with said inlet passage.

2. A device as defined in claim 1, and wherein:

said coupling means comprises unidirectional clutch means for causing said magazine means to be rotated with said motor means, yet permitting said magazine means to be rotated in one direction without rotation of said motor means.

3. A device as defined in claim 1, wherein:

said exhaust passage is adapted to communicate between said motor means and the exterior of said housing, and further comprises check valve means for preventing entry of a surrounding fluid medium into said exhaust passage and motor means.

4. A device as claimed in claim 1, and further comprising:

a pressure bleed-off passage adapted to communicate between said inlet passage and the exterior of said housing, and check valve means for preventing entry of a surrounding fluid medium through said bleed-off passage into said inlet passage and motor means.

5. A device as defined in claim 2, and further comprising:

indicator means, connected to said magazine means, for indicating the position thereof relative to said housing.

6. A device as defined in claim 3, and wherein:

said coupling means comprises unidirectional clutch means for causing said magazine means to be rotated with said motor means, yet permitting said magazine means to be rotated in one direction without rotation of said motor means.

7. A device as defined in claim 6, and further comprising:

a pressure bleed-off passage adapted to communicate between said inlet passage and the exterior of said housing, and check valve means for preventing entry of a surrounding fluid medium through said bleed-off passage into said inlet passage and motor means.

8. A device as defined in claim 6, and further comprising:

indicator means, connected to said magazine means, for indicating the position thereof relative to said housing.

9. A device as defined in claim 8, and wherein:

said charges comprise electrically ignitable cartridges; and said firing means comprises electrical contact means engageable with said cartridges.

10. An explosively actuated power wrench comprising:

a body having first and second axially aligned cylindrical bores;

a rotatable cylinder block mounted in said first cylindrical bore for rotation about a first axis and comprising a plurality of cylinders parallel to said first axis;

a plurality of pistons, each reciprocably received in one of said cylinders;

a rotor mounted with respect to said body for rotation about a second axis that intersects at a predetermined angle with said first axis, said rotor being connected to said pistons so as to be rotated by reciprocation thereof;

a cylindrical magazine mounted in said second cylindrical bore for rotation about said first axis, said magazine comprising a plurality of charge containing chambers disposed in equally spaced relation about said first axis;

an inlet passage defined in said body so as to extend from said magazine to said cylinder block, said inlet passage placing an aligned one of said charge containing chambers in communication with ones of said cylinders aligned with said inlet passage;

an outlet passage defined in said body so as to extend from said cylinder block to the exterior of said body and adapted to communicate with each of said cylinders in passing;

a one-way coupling interconnecting said cylinder block and said magazine whereby rotation of said cylinder block in a predetermined one direction will be accompanied by equal rotation of said magazine in said one direction, and rotation of said magazine in said one direction can be accomplished independent of rotation of said cylinder block;

a breech cap removably mounted on said body in confining relation to said magazine and presenting indicia thereon;

a handle connected to said magazine and accessible from the exterior of said breech cap, for effecting said rotation of said magazine independent of rotation of said cylinder block, said handle being cooperable with said indicia to indicate the rotative position of said magazine;

charge firing means, associated with said breech cap, for igniting each of said charges only when in alignment with said inlet passage; and a pressure bleed-off passage communicating between said inlet passage and the exterior of said body, said bleed-off passage presenting predetermined restriction to flow therethrough.

11. An explosively actuated power wrench, as defined in claim 10, and further comprising:

first check valve means, mounted on said body, for permitting exit of gases from said outlet passage and preventing entry of an ambient medium thereinto; and second check valve means, mounted on said body, for permitting restricted exit of gases from said inlet passage and preventing entry of said ambient medium thereinto.

12. An explosively actuated power wrench, as defined in claim 11, and further comprising in combination a control circuit comprising:

a source of electric current; and means for applying said electric current to said charge firing means for predetermined time periods.

* * * * *